US006443772B1

(12) United States Patent
Chen

(10) Patent No.: US 6,443,772 B1
(45) Date of Patent: Sep. 3, 2002

(54) COMMON TWO-PRONG AND THREE-PRONG SOCKET AC POWER RECEPTACLE

(75) Inventor: Ken-Ching Chen, Hsin-Chuang (TW)

(73) Assignee: Hong Gy Co., Ltd., Hsin-Chuang (TW)

( * ) Notice: Subject to any disclaimer, the term of this patent is extended or adjusted under 35 U.S.C. 154(b) by 0 days.

(21) Appl. No.: 09/891,979

(22) Filed: Jun. 26, 2001

(51) Int. Cl.[7] ..... H01R 25/16

(52) U.S. Cl. ..... 439/652; 439/214; 200/51.03; 200/51.02

(58) Field of Search ..... 439/652, 222, 439/224, 218, 535, 107, 214; 200/51.02, 51.03

(56) References Cited

U.S. PATENT DOCUMENTS 4,867,701 A * 9/1989 Wiand ..... 439/652
5,292,257 A * 3/1994 Milan ..... 439/214
5,708,554 A * 1/1998 Liner ..... 439/652
6,086,397 A * 7/2000 Chapman et al. ..... 439/214
6,113,434 A * 9/2000 Pate ..... 439/535

* cited by examiner

*Primary Examiner*—Gary F. Paumen
(74) *Attorney, Agent, or Firm*—Thorp Reed & Armstrong, LLP

(57) ABSTRACT

A common two-prong and three-prong socket AC power receptacle has several sockets that are provided on a top and one side surface on a casing. One end of the casing has a switch. The sockets on the top surface of the casing are three-prong ones and those on the side surface are two-prong. Some sockets are directly connected to a power cord. The others are connected in series to a switch, where the switch can control whether they are on or off. This design can provide users more socket space to use and better controls.

4 Claims, 4 Drawing Sheets

COMMON TWO-PRONG AND THREE-PRONG SOCKET AC POWER RECEPTACLE

BACKGROUND OF THE INVENTION

1. Field of Invention

The invention relates to a common two-prong and three-prong socket AC power receptacle. More particularly, it relates to a multi-socket receptacle that has three-prong sockets on the top surface and two-prong socket on one side surface of the receptacle casing. Through appropriate arrangement of the sockets, space can be utilized in a better way.

2. Related Art

In modern society, people have a larger demand for electronics for a more convenient lifestyle. Since each electronic device needs at least one socket for electricity, more sockets are needed on a receptacle.

The traditional multi-socket receptacle has a casing composed of an upper lid and a bottom casing. A series of sockets are provided on the upper lid. A power cord with a plug on a distal end extends out of one end of the casing. This kind of multi-socket receptacle design and configuration has been used for a long time. The available sockets on a single receptacle are often insufficient for practical application. A typical computer system may require a lot of sockets. Furthermore, peripheral devices such as modems, speakers and scanners often use adapters with a larger volume than ordinary plugs. When one of such adapters is plugged into one socket of the multi-socket receptacle socket, adjacent sockets are often blocked. Therefore, the conventional multi-socket receptacle is very inconvenient for such applications.

For an ordinary computer user, an extension cord with multiple sockets is definitely required when even basic peripheral devices are included. However, such devices usually have different types of plugs. Basically, computers and printers use three-prong plugs, and other peripheral devices use two-prong plugs. If the user gets an extension cord with two-prong sockets, three-prong plugs cannot be plugged into the receptacle. At this point, most users obtain three-prong-to-two-prong converters, while others just ignore the ground pole and cut it off the plug. The later method totally negates the protection provided by the ground prong on the plug. Also, some merchants simply take off the ground prong from the plug. Although this method solves the problem of plugging three-prong plugs into two-prong sockets, the ground protection is lost. Furthermore, even if the user purchases a new three-prong socket, the grounding protection cannot be restored to the broken plug.

As a practical matter, some peripheral devices are turned on only when necessary. That is, they are often turned on and off at the same time. However, some other devices have to be turned on all the time (e.g., modems, UPS, etc). If a receptacle without a switch or switches is selected for use, then the plugs or adapters for the devices not in use have to be unplugged. The plugs have to be stored at some corner of the computer desk before being plugged back in for the next use, or the user has to find the switches at various places on those devices and turn them off individually. This is indeed very inconvenient in operations. If the user selects a receptacle with multiple switches, then he or she has to turn them off one by one. Despite the fact that it is more convenient than the receptacle without any switches, there is still some risk of turning on or off the wrong device.

SUMMARY OF THE INVENTION

Accordingly, an objective of the invention is to provide a common two-prong and three-prong AC power receptacle. Several pairs of sockets are provided on the top and one side surface of the casing. A switch is mounted on one end of the casing. The sockets on the top surface are three-prong and the ones on the side surface are two-prong. Some of the sockets are directly connected in series to the power cord and are electrically "hot" all the time. A switch is connected in series between the power cord and the other sockets. The switch controls whether they are conducting. This design can provide users more sockets to use and better controls.

DETAILED DESCRIPTION OF THE INVENTION

Figure 1:
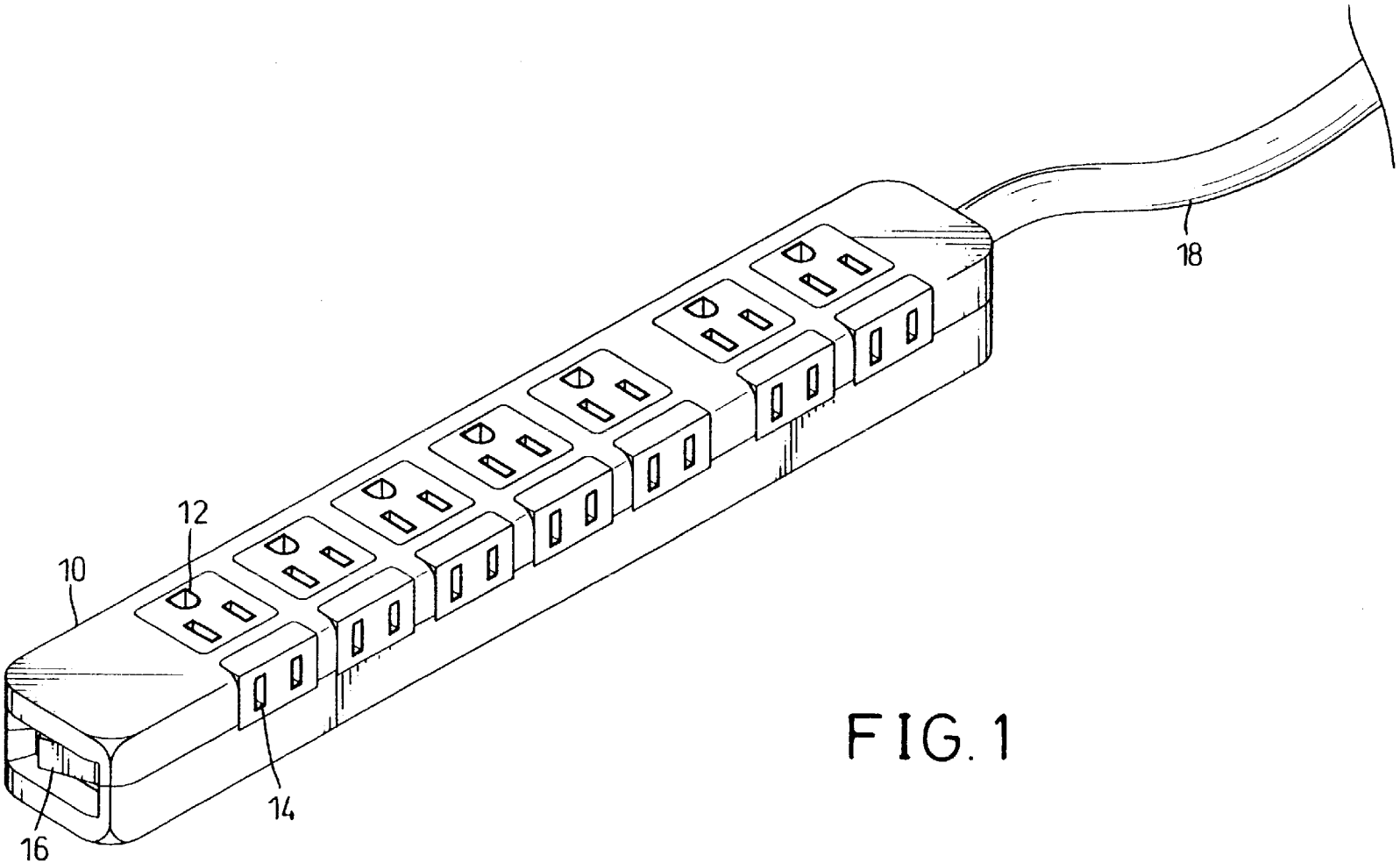
FIG. 1 is a perspective view of the common two-prong and three-prong socket AC power receptacle in accordance with the present invention.

With reference to FIG. 1, the common two-prong and three-prong socket AC power receptacle in accordance with the present invention comprises a casing (10), multiple three-prong sockets (12), multiple two-prong sockets (14), a switch (16) and a power cord (18). The casing (10) is an elongated cuboid with a top, a bottom, two sides and two ends. Multiple three-prong sockets (12) and two-prong sockets (14) are respectively mounted in pairs on the top and one side of the casing (10). A switch (16) is mounted on one end of the casing 10. A power cord (18) is attached to the other end of the casing (10). The sockets on the top surface of the casing (10) are three-prong sockets (12), whereas those on the side of the casing (10) are two-prong sockets (14).

Figure 2:
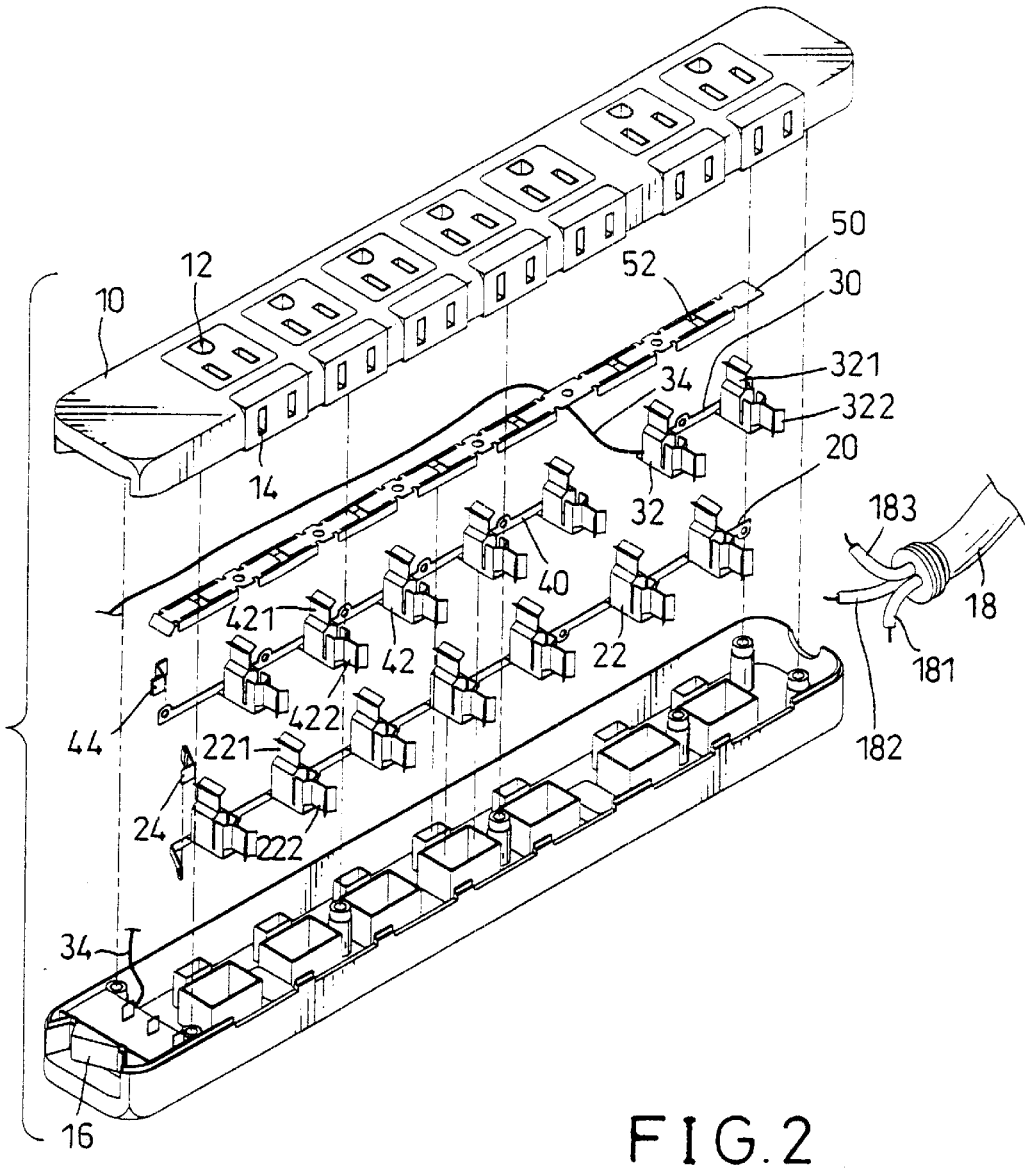
FIG. 2 is an exploded perspective view of the common two-prong and three-prong socket AC power receptacle in FIG. 1.

With reference to FIG. 2, the internal components of the casing (10) comprise multiple electrode plates (20, 30. 40), a ground plate (50), electrical wire (34), the switch (16) and one end of the power cord (18). Each electrode plate (20, 30, 40) comprises multiple clip contact sets (22, 32, 42). Each clip contact set (22, 32, 42) has a clip contact (221, 321, 421) for a three-prong socket (12) and a clip contact (222, 322, 422) for a two-prong socket (14). The power cord (18) comprises two electrical wires (181, 182) and a ground wire (183). For illustrative purposes only, the embodiment of the common two-prong and three-prong socket AC power receptacle in accordance with the present invention is described with two pairs of "hot" two and three-prong sockets (14, 12) and five pairs of two and three-prong sockets (14, 12) that can be selectively turned on or off as a group.

A first electrode plate (20) common to all of the sockets (12, 14) in the receptacle is mounted in the casing (10). The first electrode plate (20) comprises multiple clip contact sets (22) at positions corresponding to all of the sockets. One end of the first electrode plate (20) is connected. to the first electrical wire (181) in the power cord (18). The other end of the first electrode plate 20 is connected to the switch 16 using a connector plate 24.

A second electrode plate 30 common to the sockets (12, 14) that are "always hot" is mounted in the casing (10). The second electrode plate (20) comprises two clip contact sets (32) at the positions corresponding to the two sockets (12, 14) that are "always hot." One end of the second electrode plate (30) is connected to a second electrical wire (182) in the power cord (18). The other end is connected to the switch (16) by an electrical wire (34).

A third electrode plate (40) common to the sockets (12, 14) that can be selectively switched on and off is mounted in the casing (10). The third electrode plate (40) comprises five clip contact sets (42) at positions corresponding to the five sockets that can selectively turned on or off. One end of the third electrode plate (40) is connected to the switch (16) by a connector plate (44).

A ground plate (50) common to all the three-prong sockets (12) is mounted in the casing 10. The ground plate 50 comprises contacts (52) at positions corresponding to the ground holes in the three-prong sockets (12). The ground plate (50) is connected to the ground wire (183) in the power cord (18).

Figure 3:
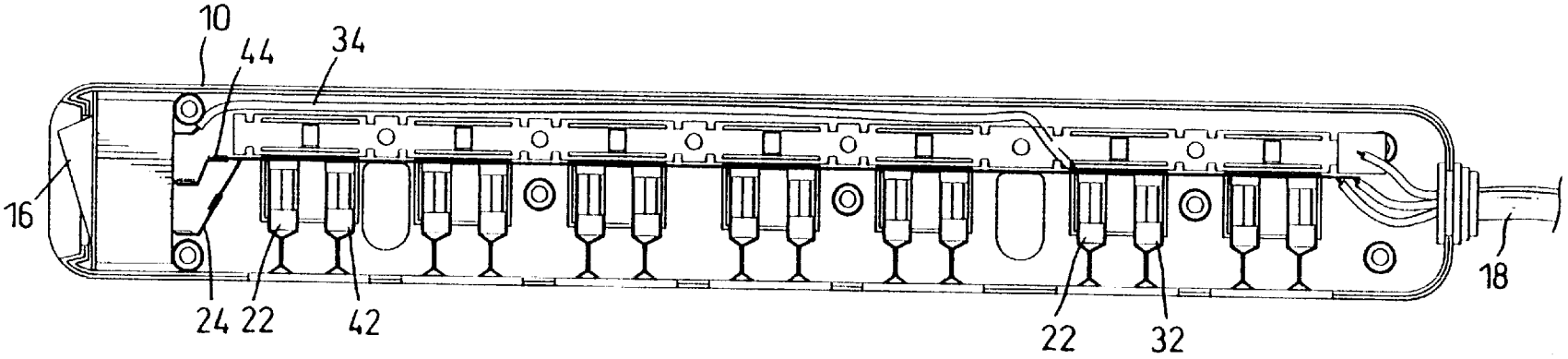
FIG. 3 is a top plan view of the interior of the common two-prong and three-prong socket AC power receptacle in FIG. 1.
Figure 4:
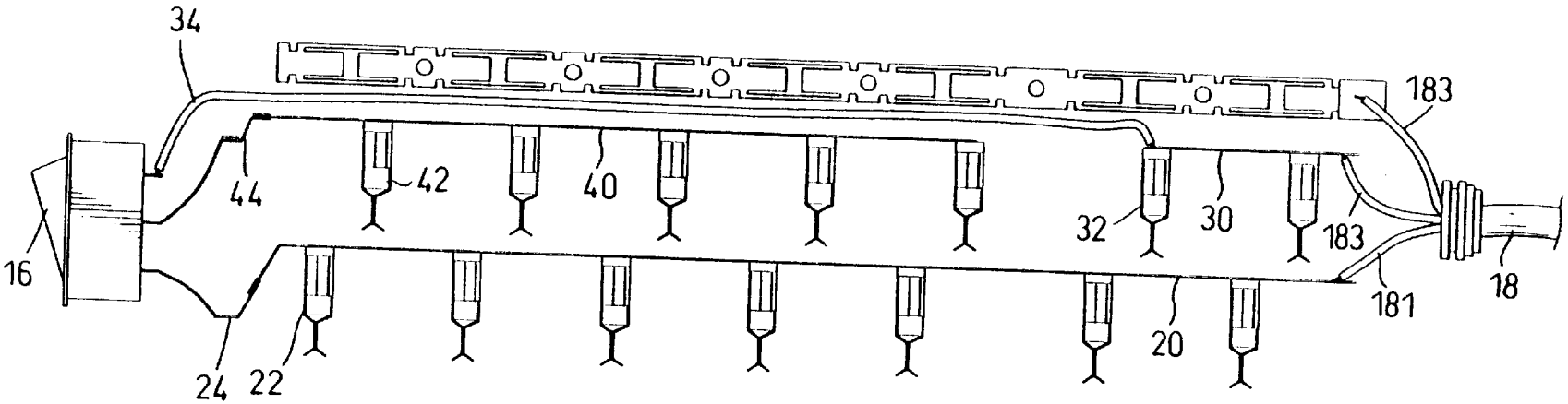
FIG. 4 is an electrical connection diagram for the common two-prong and three-prong socket AC power receptacle in FIG. 1.

With reference to FIGS. 3 and 4, each of the clip contacts (221, 222) on the clip contact sets (22) on the first electrode plate (20) corresponds to one hole in the three-prong sockets (12) and one of the holes in the two-prong sockets (14). The clip contacts (321, 322) on the two clip plates (32) on the second electrode plate (30) and the clip contacts (421, 422) on the five clip contact sets (42) of the third electrode plate (40) correspond to the other plug hole in the three-prong sockets 12 and the two-prong sockets 14.

With reference to FIG. 4, the first electrode plate (20) is directly connected to the first electrical wire (181), and the second electrode plate (30) is directly connected to the second electrical wire (182). Therefore, the two pairs of sockets (12, 14) corresponding to the two clip contact sets (32) on the second electrode plate (30) are "hot" whenever the power cord (18) has power. The third electrode plate (40) is sequentially connected in series to the connector plate 44, the switch 16, the conducting wire 34 and the second electrode plate (30). Thus, the conductive path the five pairs of sockets (12, 14) corresponding to the clip contact sets (42) on the third electrode plate (40) is controlled by the switch (16).

The common two-prong and three-prong socket AC power receptacle as previously described allows a user to provide power to devices that must have power all the time and to selectively control power to a group of other devices. Consequently, the invention provides the optimal convenience in operations.

The invention may be varied in many ways by a skilled person in the art. Such variations are not to be regarded as a departure from the spirit and scope of the invention, and all such modifications are intended to be included within the scope of the following claims.

What is claimed is:

1. A common two-prong and three-prong socket AC power receptacle, which comprises:

a casing, which has a top surface, a side surface, a first end, and a second end;

a plurality of three-prong sockets (12) on the top surface;

a plurality of two-prong sockets (14) on the side surface;

a first wire (181);

a second wire (182);

a ground wire (183);

a first electrode plate (20);

a second electrode plate (30);

a third electrode plate (40); and a ground plate (50);

wherein the first electrode plate (20), the second electrode plate (30), the third electrode plate (40) and the ground plate (50) are mounted in the casing (10);

the casing (10) has a switch (16) on the first end of the casing and a power cord (18) extending from the second end of the casing, some sockets (12, 14) are directly connected to the first wire (181) and the second wire (182) in the power cord (18), respectively, and therefore provide power all the time, and the others are connected with the switch (16) in series with one leg of the circuit, and whether or not they provide power is thus controlled by the switch (16);

the first electrode plate (20) comprises a plurality of clip contact sets (22) at positions corresponding of the sockets, the first electrode plate (20) being connected between the first wire (181) in the power cord (18) and the switch (16);

the second electrode plate (30) is formed with a plurality of clip contact sets (32) at positions corresponding to some of the sockets, the second electrode plate (30) being connected between the second wire (182) of the power cord (18) and the switch (16);

the third electrode plate (40) comprises a plurality of clip contact sets (42) at positions corresponding to some of the sockets, the third electrode plate (40) being connected with the switch (16); and the ground plate (50) is formed with contacts (52) at positions corresponding to ground holes in the three-prong socket sets (12) and is connected with a ground wire (183) in the power cord (18).

2. The socket of claim 1, wherein the first electrode plate 20 and the switch 16 are connected using a connector plate 24.

3. The socket of claim 1, wherein the second electrode plate (20) and the switch (16) are connected using an electrical wire (34).

4. The socket of claim 1, wherein the third electrode plate (40) and the switch (16) are connected using a connector plate (44).

* * * * *